US006634674B1

(12) United States Patent
Xu

(10) Patent No.: US 6,634,674 B1
(45) Date of Patent: Oct. 21, 2003

(54) TELESCOPIC DUST-COLLECTING PIPE FOR VACUUM CLEANER

(76) Inventor: Weier Xu, 108-3 Jinshan Road, New District, Suzhou 215011, Jiangsu Province (CN)

( * ) Notice: Subject to any disclaimer, the term of this patent is extended or adjusted under 35 U.S.C. 154(b) by 88 days.

(21) Appl. No.: 09/701,715

(22) PCT Filed: Jun. 2, 2000

(86) PCT No.: PCT/CN00/00136

§ 371 (c)(1),
(2), (4) Date: Dec. 1, 2000

(87) PCT Pub. No.: WO00/14876

PCT Pub. Date: Mar. 16, 2000

(30) Foreign Application Priority Data

Jan. 12, 2000 (CN) ..... 00216141

(51) Int. Cl.[7] ..... A47L 9/24
(52) U.S. Cl. ..... 285/7; 285/302; 285/303
(58) Field of Search ..... 285/7, 302, 303

(56) References Cited

U.S. PATENT DOCUMENTS 3,351,359 A * 11/1967 Ferraris ..... 285/7
5,692,782 A * 12/1997 Fischer ..... 285/7
5,740,583 A * 4/1998 Shimada et al. ..... 15/377
5,941,575 A 8/1999 Herbst

FOREIGN PATENT DOCUMENTS

| | | |
|---|---|---|
| CN | 98103742.9 | 9/1998 |
| EP | 0293 518 | 12/1987 |
| EP | 0858 762 | 2/1997 |
| JP | 9253014 | 9/1997 |

* cited by examiner

*Primary Examiner*—Lynne H. Browne
*Assistant Examiner*—Giovanna M Collins
(74) *Attorney, Agent, or Firm*—Needle & Rosenberg, P.C.

(57) ABSTRACT

A telescopic dust collecting pipe includes an outer pipe, an inner pipe inserted in the outer pipe, and a locking mechanism used for locking the relative position of the outer and inner pipe. The inner pipe and the controlling rod form an outer layer oriented groove and an inner layer oriented groove. Relative movement of the controlling rod and inner pipe brings the outer layer oriented groove to coincide or stagger with the inner layer oriented groove. A locking element moved along the radial direction is arranged between the outer pipe and inner pipe. The locking element is pressed against one side of the inner pipe by an elastic element. The relative movement between the controlling rod and inner pipe can cause the double layer oriented grooves to be coincided or staggered, so as to press or to push the locking element into or out of the oriented groove, so that the outer pipe and inner pipe are locked or released.

23 Claims, 11 Drawing Sheets

TELESCOPIC DUST-COLLECTING PIPE FOR VACUUM CLEANER

RELATED FIELD

This application claims the benefit of International Application No. PCT/CN00/00136, filed Jun. 2, 2000, which claims benefit of Chinese Application No. 00216141.9, filed Jan. 12, 2000, which status is pending.

The present invention relates to a vacuum cleaner, especially to an telescopic dust-collecting pipe for vacuum cleaner.

TECHNICAL BACKGROUND

The known technology, such as EP0293518, has disclosed a dust collecting pipe of vacuum cleaner, including inner pipe, outer pipe and locking mechanism. While pushing the button of said locking mechanism in one direction, locking mechanism could be released, and inner pipe could be extended or contracted relative to outer pipe. However, the button could be pushed only in one direction to release the locking mechanism, while extending and contracting the dust-collecting pipe, the directions of the force applied on dust-collecting pipe are opposite. Therefore, the directions of force applied on button and on dust collecting pipe with same hand may be right opposite and it is inconvenient for operating.

BRIEF DESCRIPTION OF THE INVENTION

One object of the invention is to provide an telescopic pipe which may have locking mechanism with double direction of operating. So as to achieve the applying force direction of operating locking mechanism to be released may be the same as the applying force directions of operating dust collecting pipe extending and contracting. It is more convenient to operate dust-collecting pipe to be extended and contracted.

The technical scheme of the invention is in that an telescopic dust collecting pipe for vacuum cleaner includes outer pipe, inner pipe inserted in the outer pipe and locking mechanism used for locking relative position of inner pipe and outer pipe. The characteristic is in that the oriented groove is arranged axially at intervals on outer surface of said inner pipe. Controlling rod is provided slidingly in inner pipe, oriented groove corresponding to the oriented groove on inner pipe is arranged at same intervals on the controlling rod to form outer layer oriented groove and inner layer oriented groove. The relative movement between controlling rod and inner pipe causes outer layer oriented groove to coincide or stagger with inner layer oriented groove. Locking element movable along axial direction is arranged between outer pipe and inner pipe, the locking element is pressed against one side of inner pipe by elastic element. While two layers of oriented groove are coincided, the locking element is pressed into the oriented grooves coincided, outer pipe and inner pipe are locked relatively. While two layers of oriented groove are staggered, locking element is pushed out of oriented groove, locking condition between outer pipe and inner pipe is released.

The present invention utilizes a two layers structure of oriented groove. Therefore, double directional relative movement back and forth between controlling rod and inner pipe can bring outer layer oriented groove to stagger with inner layer oriented groove. And during the movement of staggering, locking element is pushed up by using the groove wall of inner layer oriented groove so as to release locking device. Such that the direction of releasing locking movement of double direction is the same as the direction of extending and contracting movement of double direction of dust collecting pipe. Therefore, during pushing and pulling in the invention, the direction of applying force acted on operating device with one hand may be same as the direction of pulling and pushing dust-collecting pipe so as to achieve the object of convenient operation.

DETAILED DESCRIPTION OF THE INVENTION

Embodiment 1

Figure 1:
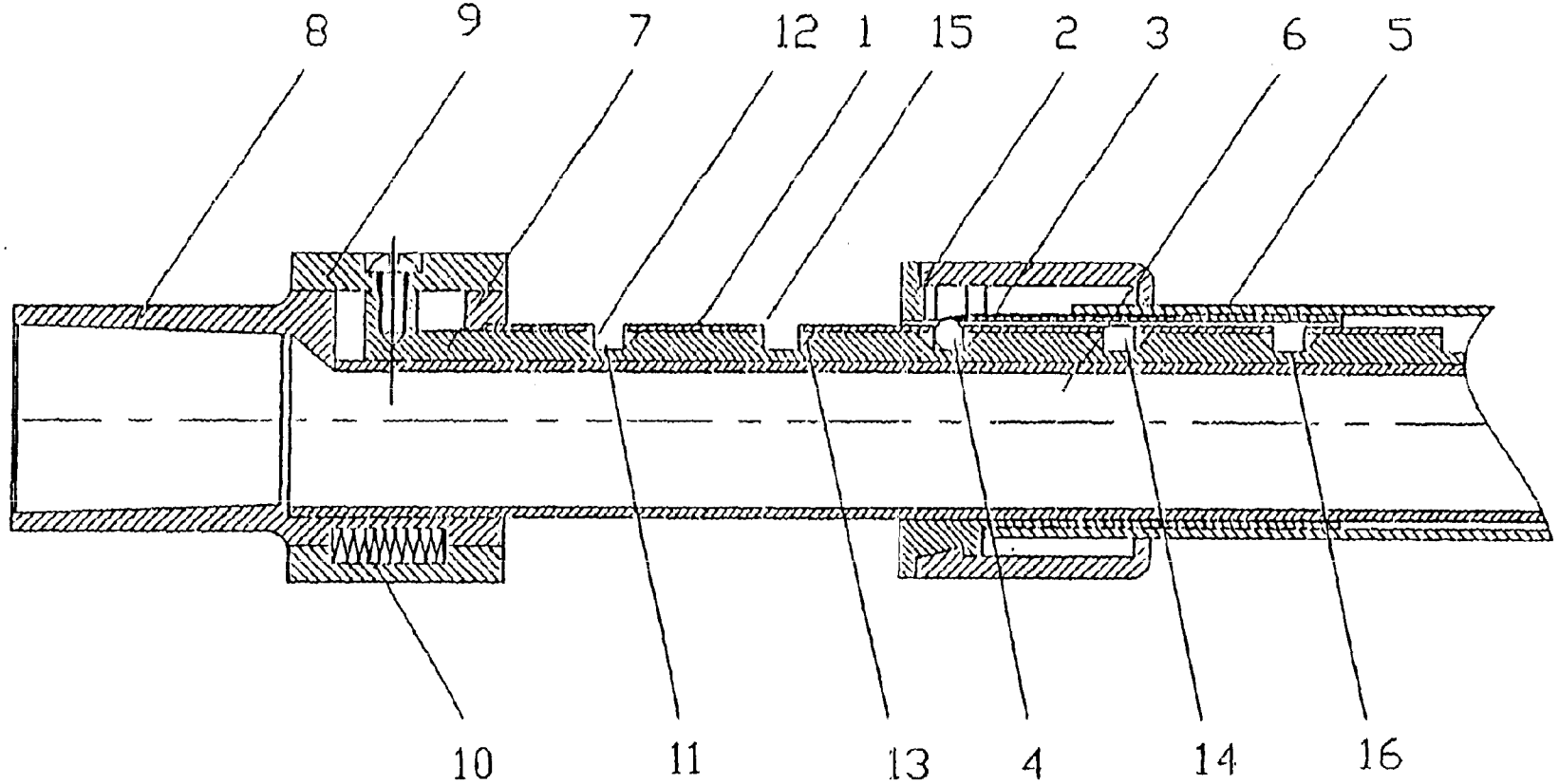
FIG. 1 is a structural sketch of the first embodiment in locking state of the invention.
Figure 2:
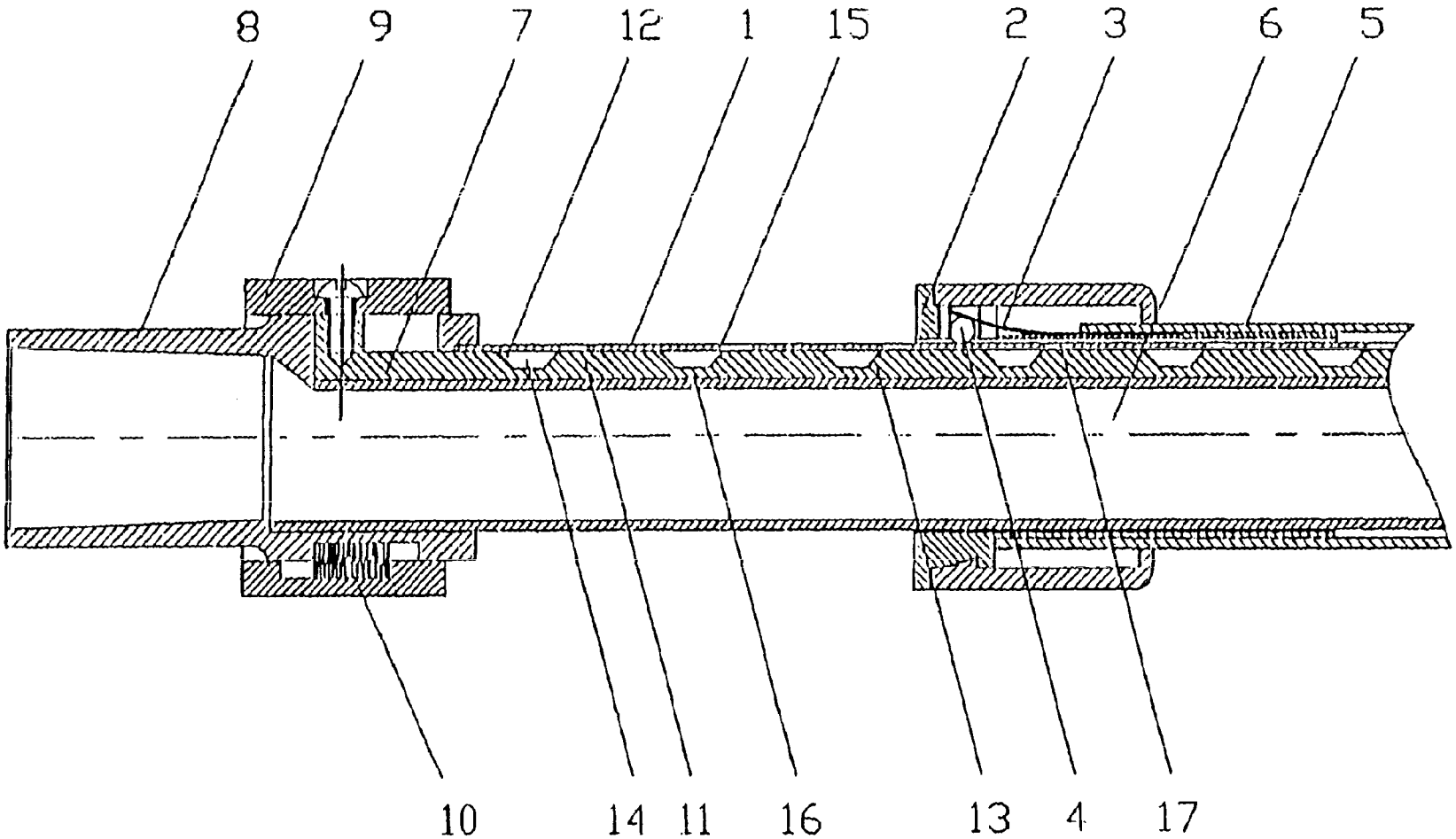
FIG. 2 is a structural sketch of the first embodiment in releasing state of the invention.
Figure 3:
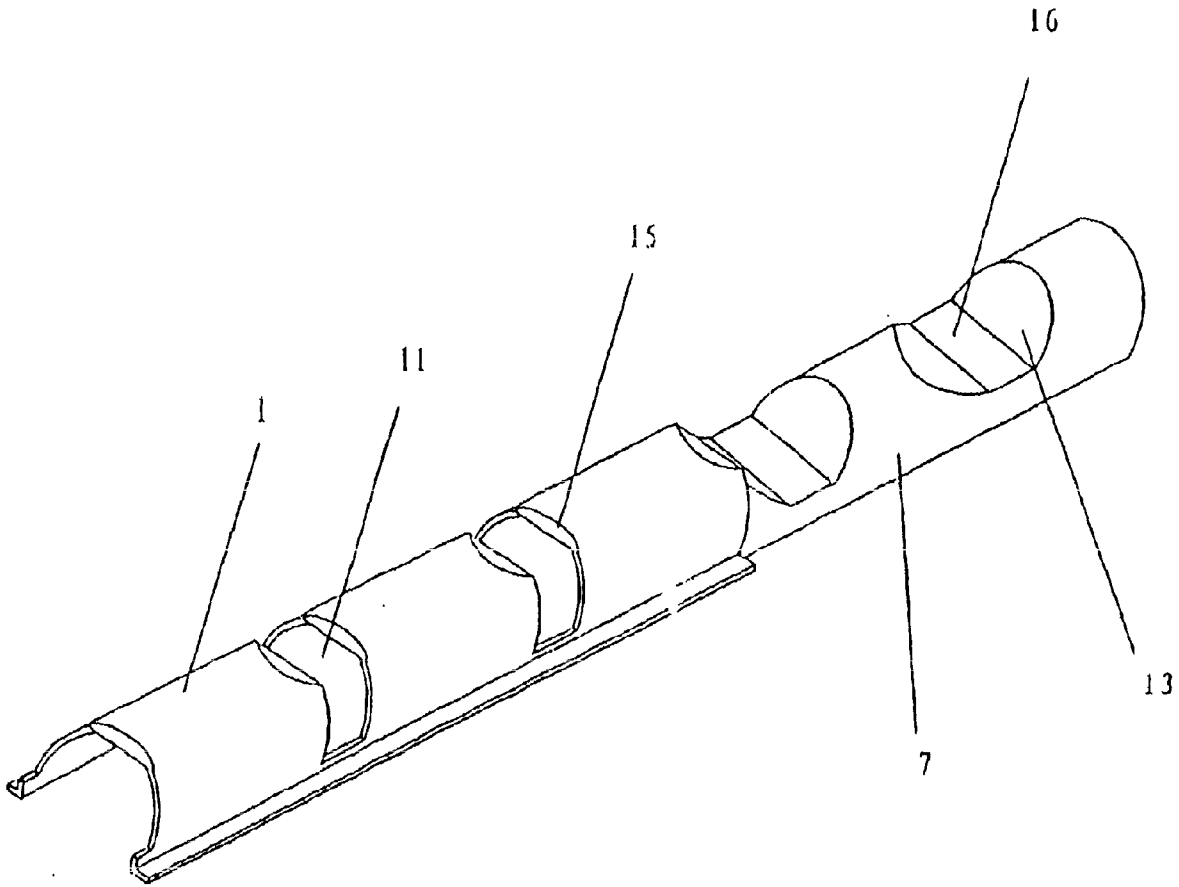
FIG. 3 is a structural sketch of hollow rack of the first embodiment of the invention.

Referring as shown in FIGS. 1 and 2, the invention provides an telescopic dust collecting pipe for vacuum cleaner that includes outer pipe 5, inner pipe 6 inserted in the outer pipe 5, and locking mechanism using to lock relative position of outer pipe 5 and inner pipe 6. In the embodiment, the outer layer oriented groove 11 on the outer surface of inner pipe 6 is arranged axially at intervals. Controlling rod 7 is arranged slidingly on the inner wall of inner pipe 6. The controlling rod 7 is connected with operating device 9. The inner layer oriented groove 14 corresponding to outer layer oriented groove 11 is arranged on controlling rod 7. As shown in FIG. 3, in the embodiment a hollow rack 1 is arranged on inner pipe 6 firmly. In the embodiment, hollow rack 1 has a section of half-circle shape. Said outer layer oriented groove 11 is arranged on the section of half-circle shape of hollow rack. Above said controlling rod 7 is arranged through the hollow rack 1 and connected slidingly along inner wall of hollow rack 1.

The back end of controlling rod 7 is connected with operating device 9, the operating device 9 may be a sliding sleeve sheathed on outer pipe 5. Pulling the operating device 9 forward or backward can all pull controlling rod 7 to move axially along inner wall of inner pipe 6 to control outer layer oriented groove 11 to coincide or stagger with inner layer oriented groove 14.

In the embodiment, locking device includes locking element 4 arranged between outer pipe 5 and inner pipe 6 and may moving along radial direction, and elastic element 3. In the embodiment, the locking element 4 is roller. The roller is pressed against one side of inner pipe 6 by elastic element 3. While outer layer oriented groove 11 is coincided with inner layer oriented groove 14, the locking element 4 is pressed into the grooves coincided, outer pipe 5 and inner pipe 6 are locked relatively. While controlling rod 7 moves axially to cause inner layer oriented groove 14 staggering with outer layer oriented groove 11, locking element 4 is pushed out of inner layer oriented groove 14 by side groove wall of inner layer oriented groove 14, locking state of outer pipe 5 and inner pipe 6 is released, then extending and contracting operation is achieved.

As shown in FIG. 3, in the embodiment, side wall 13 of inner layer oriented groove 14 is in sloped condition, its intersection of two groove walls 13 is in lower part 16 of the groove bottom of said inner layer oriented groove 14. End sleeve 2 is fixed on outer pipe 5. The above said locking mechanism is arranged in the end sleeve 2. While controlling rod 7 moves axially relative to inner pipe 6 and causes the oriented grooves stagger, locking element 4 is pushed out of oriented grooves by the pushing of sloped face of groove wall 13 of inner layer oriented groove 14. Inner pipe 6 and outer pipe 5 is in releasing state. In the embodiment, leading sloped face 15 is provided on the groove wall face 12 of outer layer oriented groove 11. Therefore locking element 4 may sliding along leading sloped face 15 of said outer layer oriented groove 11, acts for enhancing hand-sense and leading locking element 4 to enter into next outer layer oriented groove 11.

In the invention, roller is adopted as locking element 4. Therefore, the section of hollow rack 1 is of half-circle shape and the moving distance of locking element 4 of roller shape between locking state and unlocking state could be reduced. And operating device 9 is on the end of inner pipe 6 and convenient for operation.

According to the present invention when pulling operating device 9, controlling rod 7 moves axially a certain distance relative to inner pipe 6, bringing inner layer oriented groove 14 to stagger with outer layer oriented groove 11. The locking element 4 is pushed out by sloped groove wall 13 of inner layer oriented groove 14, and in releasing locking state. At this time, inner pipe 6 could be extended or contracted freely relatively to outer pipe 5. When telescopic pipe is pulled to a suitable position, releasing operating device 9 connected with controlling rod 7. Under the effect of recovering elastic element 10, controlling rod 7 is recovered to original position; at this time outer layer oriented groove 11 coincides with inner layer oriented groove 14, locking element 4 enters into the oriented grooves coincided to lock outer pipe 5 and inner pipe 6.

Embodiment 2

The structure and working principle of the embodiment are same as embodiment 1, referring as shown in FIGS. 1 and 2. The difference between the embodiment and embodiment 1 is in that, in the embodiment, hollow rack 1 is of rectangular shape and is connected with inner pipe 5 fixedly. In the rectangular rack 1, rectangular controlling rod 7 is arranged, between controlling rod 7 and hollow rack 1 is of sliding fitting. Controlling rod 7 is connected with operating device 9, and the operating device 9 brings it to move axially in hollow rack 1 so as to achieve coincided or staggered relative movement between inner layer oriented groove 14 and outer layer oriented groove 11. The other structure and working principle of the embodiment are same as embodiment 1, no more to say here.

Embodiment 3

Figure 4:
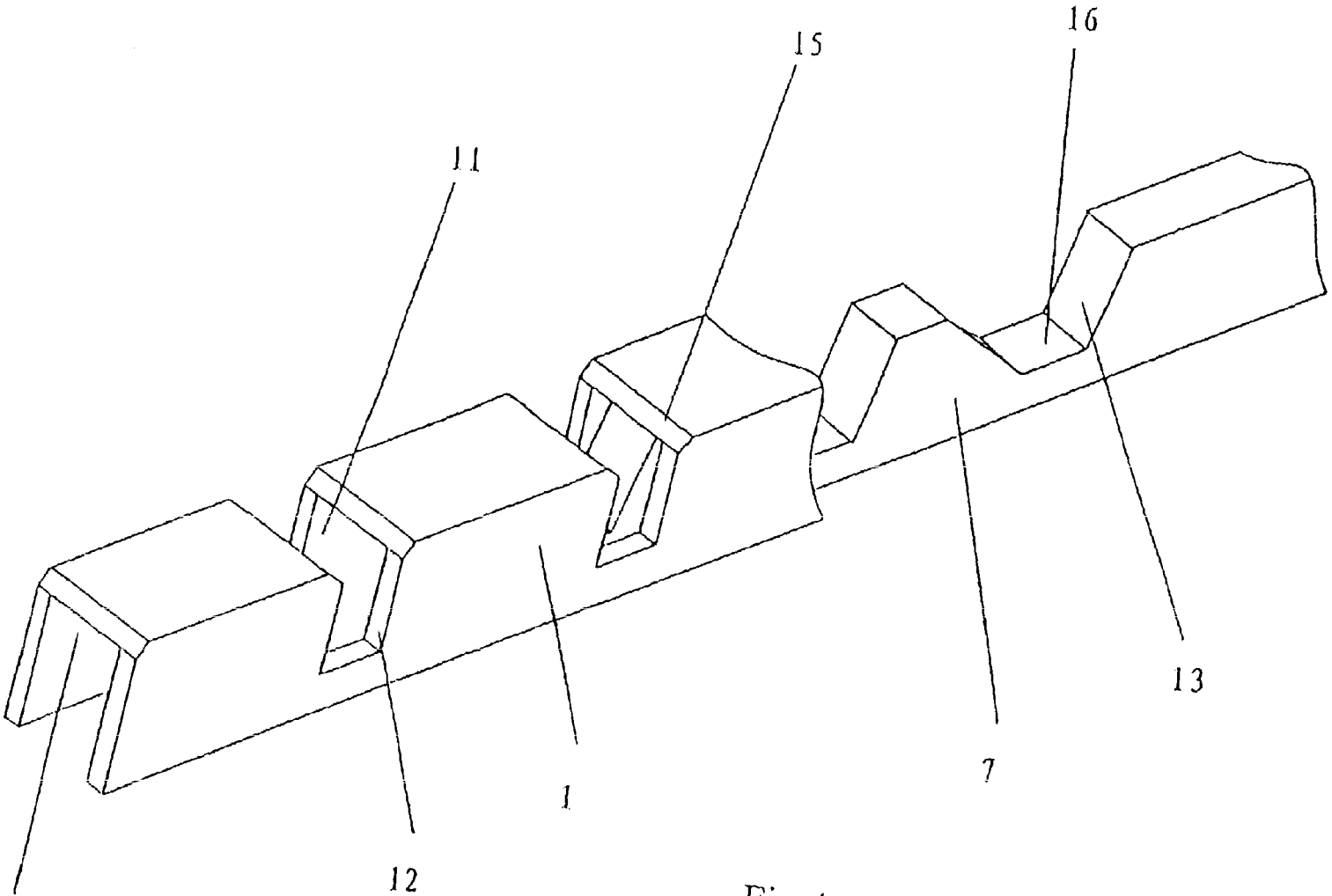
FIG. 4 is a structural sketch of hollow rack of the second embodiment of the invention.
Figure 5:
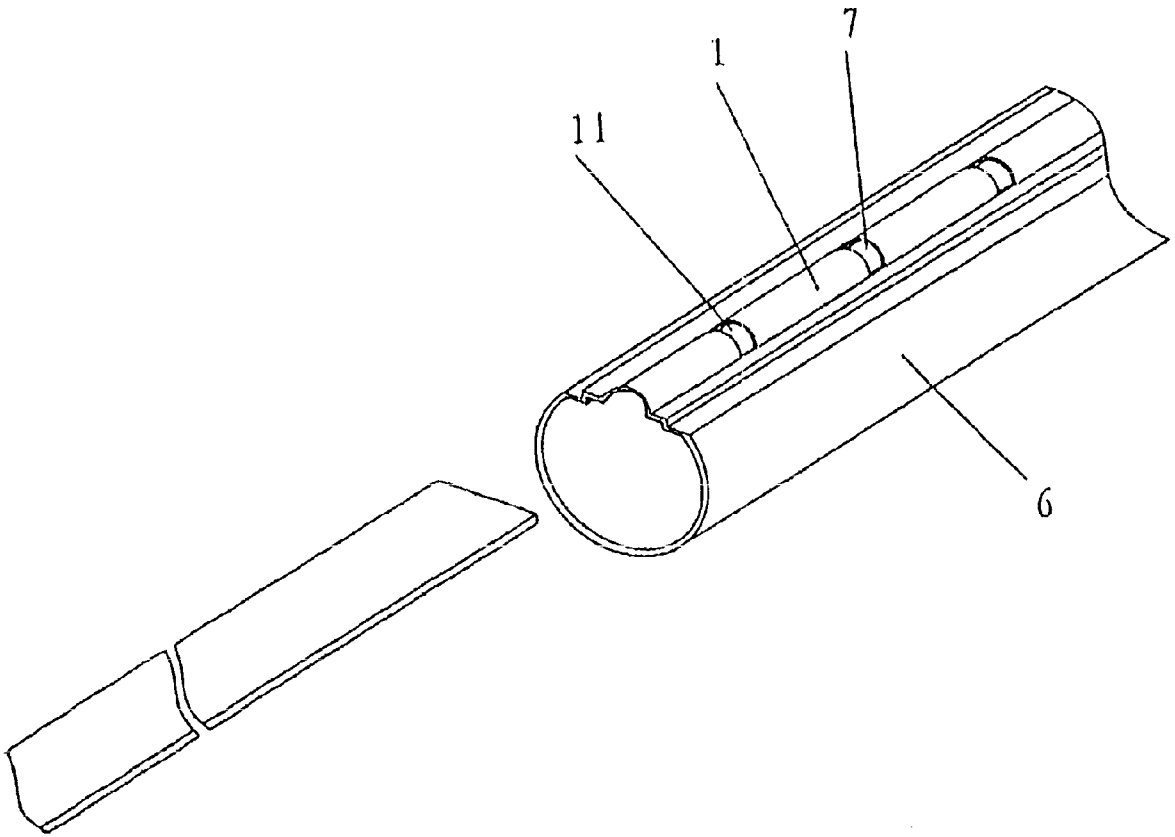
FIG. 5 is a structural sketch of hollow rack of the third embodiment of the invention.

The structure and working principle of the embodiment are same as embodiment 1, referring as shown in FIGS. 1 and 2. The difference between the embodiment and embodiment 1 is in that, in the embodiment, hollow rack 1 is formed axially by inner pipe 5 directly, as shown in FIG. 5. The hollow rack 1 formed directly may be of half-circle shape as shown in FIG. 5 or rectangular shape as shown in FIG. 4. In the hollow rack 1 controlling rod 7 is arranged, the shape of controlling rod 7 is corresponding to the shape of hollow rack 1, and between controlling rod 7 and hollow rack 1 is of sliding fitting. As shown in FIGS. 1 and 2, controlling rod 7 is connected with operating device 9, and the operating device 9 brings it to move axially in hollow rack 1, so as to achieve staggered or coincided movement of inner layer oriented groove 14 relative to outer layer oriented groove 11. The other structure and working principle of the embodiment are the same as embodiment 1, no more to say here.

Embodiment 4

Figure 6:
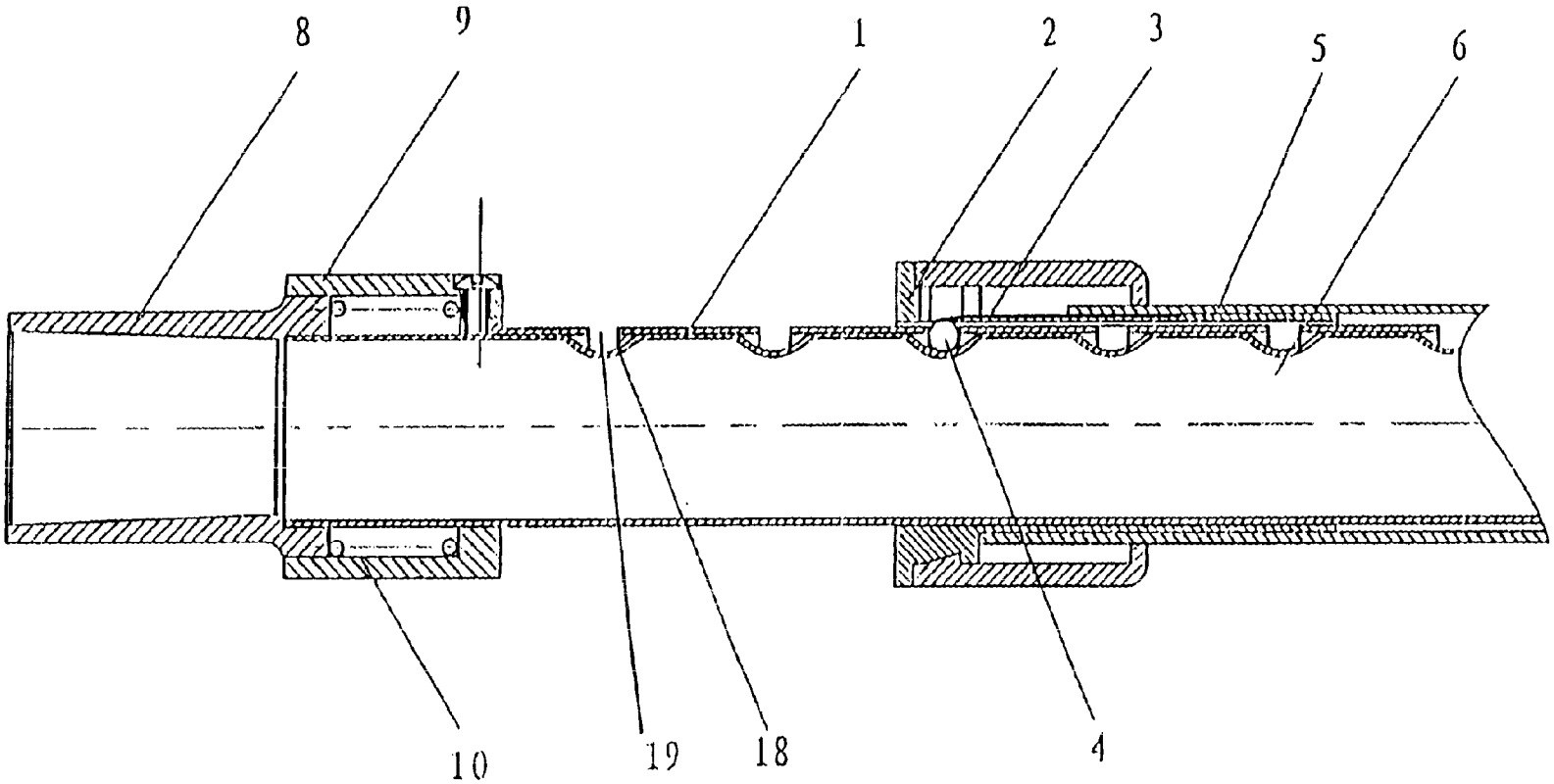
FIG. 6 is a structural sketch of the fourth embodiment of the invention.
Figure 7:
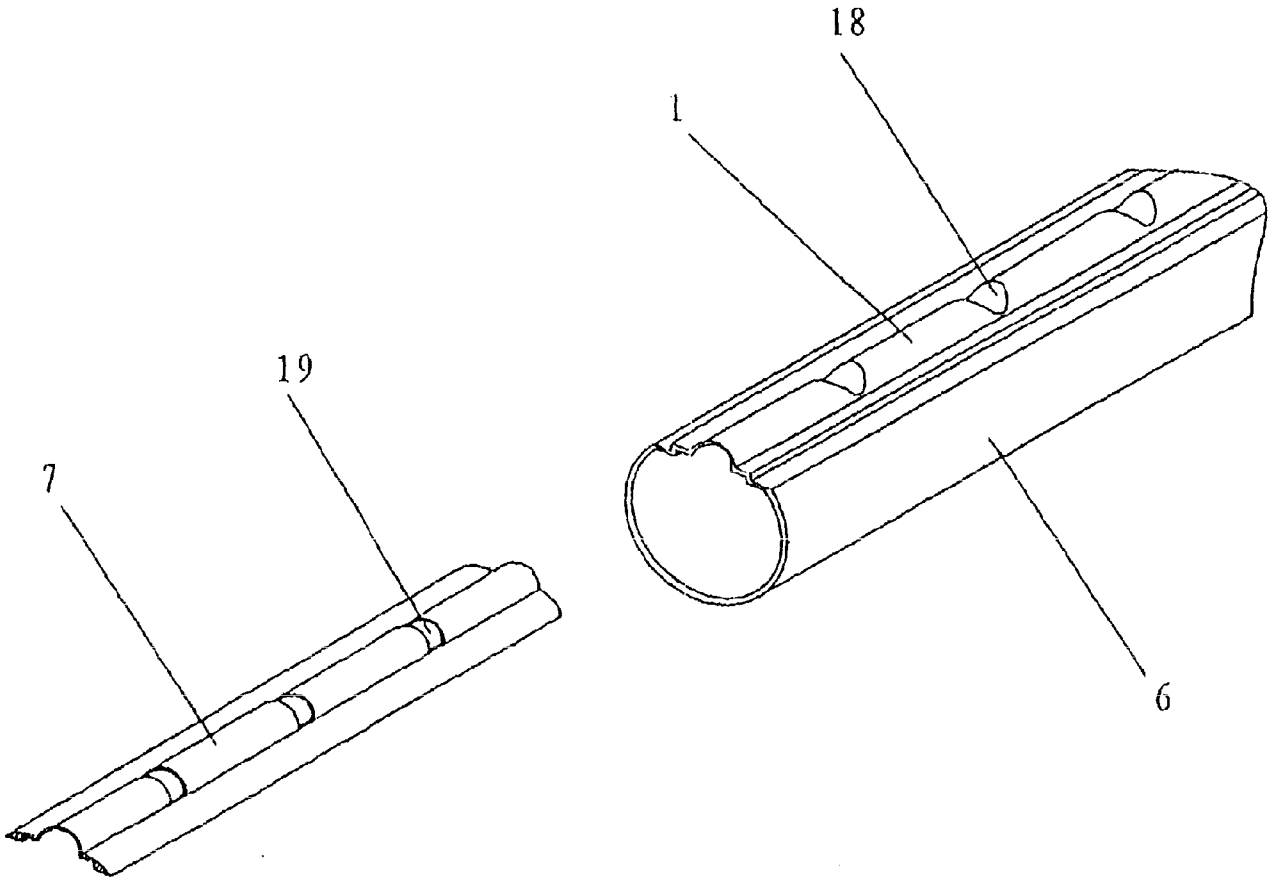
FIG. 7 is a structural sketch of inner pipe and controlling rod of the fourth embodiment of the invention.

The structure of the embodiment is referring as shown in FIGS. 6 and 7. The difference between the embodiment and embodiment 1 is in that, in the embodiment, hollow rack is formed axially by inner pipe 6 directly, as shown in FIG. 7. The hollow rack 1 formed directly may be of half-circle shape as shown in FIG. 7 and may be of rectangular shape also. Controlling rod 7 is arranged slidingly on the outside of hollow rack 1, the shape of the controlling rod 7 is corresponding to the shape of hollow rack 1 and is sliding fitting with hollow rack 1. Inner layer oriented concave groove 18 is arranged axially on hollow rack 1. Outer layer oriented groove 19 corresponding to the inner layer oriented groove 18 is arranged on controlling rod 7. As shown in FIG. 6, controlling rod 7 is connected with operating device 9, and the operating device 9 brings it to move axially along outer surface of inner pipe 6 so as to achieve coincided or staggered movement of inner layer oriented groove 18 relative to outer layer oriented groove 19.

In the embodiment, a ring shaped elastic recovering element 10 is arranged in operating device 9. Working state of the embodiment is in that, when extending dust collecting pipe is necessary, pulling controlling device 9 backward, it brings controlling rod 7 of outer layer to move backward and causes outer layer oriented groove 19 to stagger with inner layer oriented groove 18. Locking state is released. Such that the operating directions of both extending dust collecting pipe and pulling operating device 9 are the same. When it is necessary to contract dust collecting pipe, back end of inner pipe 5 is pushed forward directly, cause inner pipe 5 to move a certain distance forward relative to controlling rod 7. Outer layer oriented groove 19 is staggered with inner layer oriented groove 18. Locking state is released. Similarly, operating directions of both contracting dust-collecting pipe and pushing inner pipe 5 are the same. Since pressed distance of elastic element 10 may determine moving distance of inner pipe 5 relative to controlling rod 7. After extending or contracting operating is stopped, under the effect of the elastic element 10 the relative position of controlling rod 7 and inner pipe 6 could be determined. Outer layer oriented groove 19 is coincided with inner layer oriented groove 18. At this time, locking element 4 is clutched in oriented grooves coincided, and outer pipe 5 and inner pipe 6 is locked each other. The other structure and working principle are same as embodiment 1, no more to say here.

Embodiment 5

Figure 8:
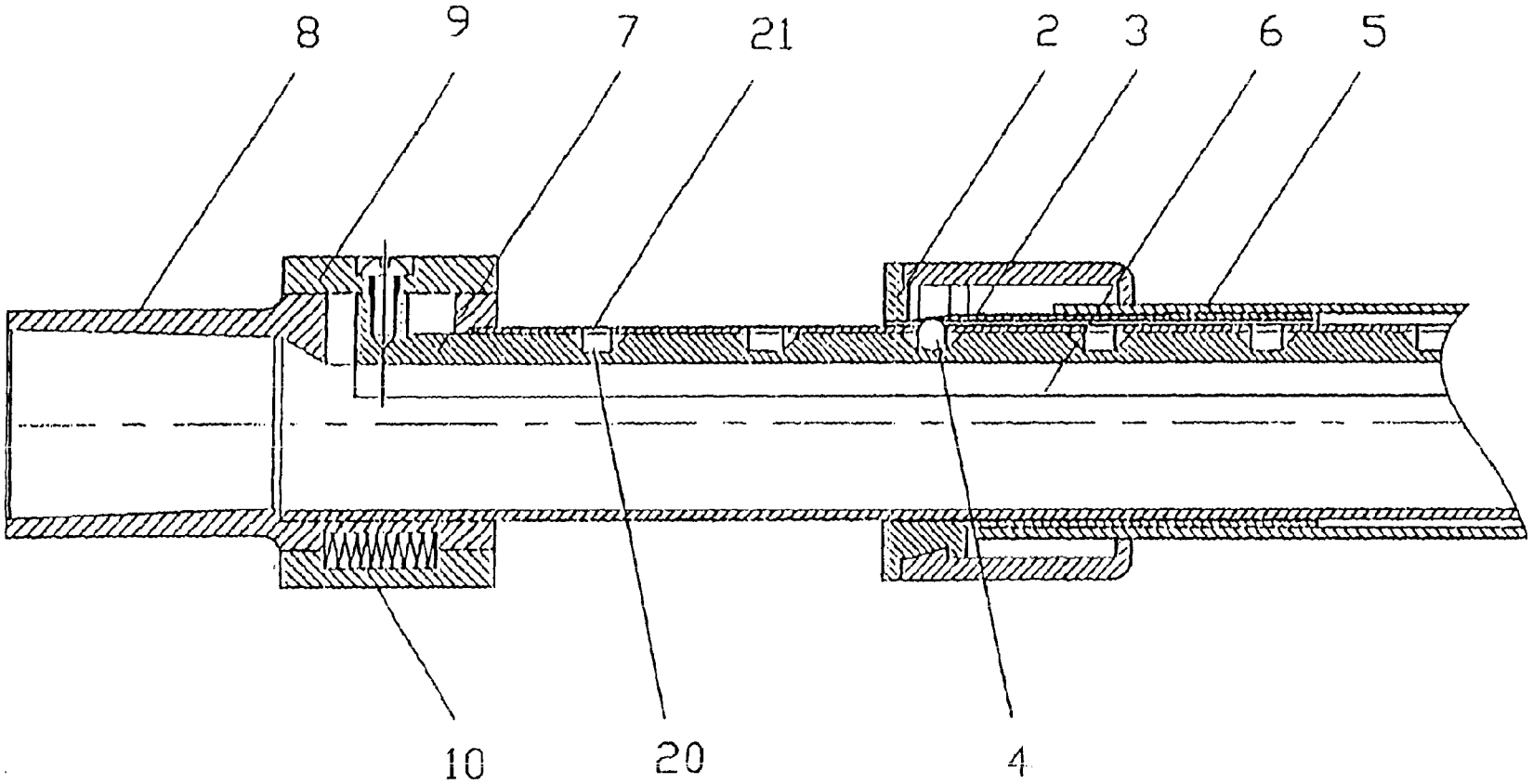
FIG. 8 is a structural sketch of the fifth embodiment of the invention.
Figure 9:
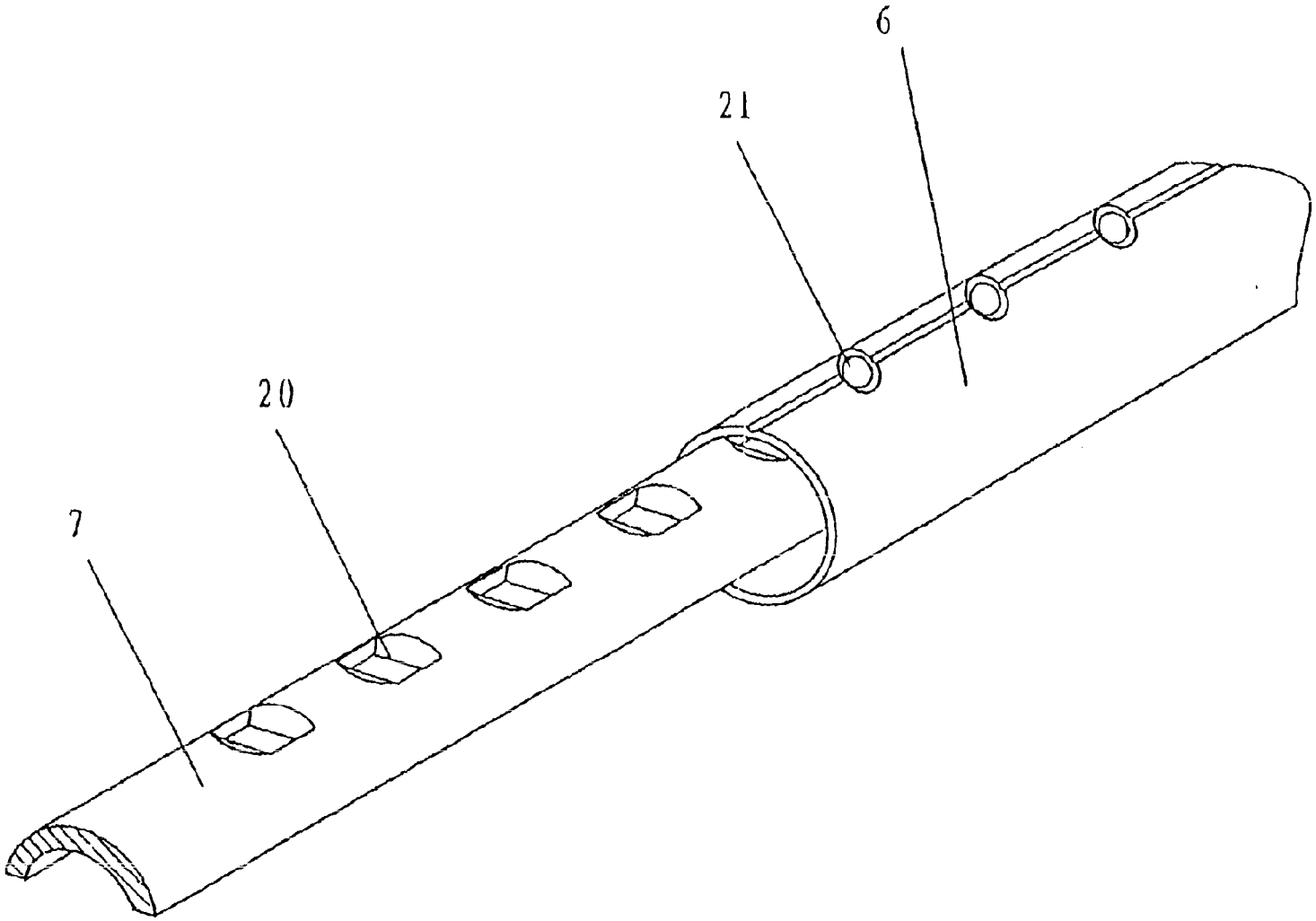
FIG. 9 is a structural sketch of inner pipe and controlling rod of the fifth embodiment of the invention.

The structure of the embodiment is shown as in FIGS. 8 and 9, including inner pipe 6 and outer pipe 5, wherein a controlling rod 7 is arranged slidingly on the inner wall of inner pipe 6. In the embodiment, outer layer oriented groove 21 is arranged axially on inner pipe 6. It is preferable, that the outer layer oriented groove 21 is a through hole, and shallower concave groove could be arranged axially to communicate with outer layer oriented grooves 21 arranged axially. The shape of controlling rod 7 corresponds to the shape of inner wall of inner pipe 6, inner layer oriented groove 20 is arranged on it axially. In order to match the structure of both inner and outer layer oriented grooves of the embodiment, in the embodiment, locking element 4 may be a rolling ball, the rolling ball is pressed on one side of inner pipe 6 by a elastic element 3. When axial relative movement between controlling rod 7 and inner pipe 6 is produced, outer layer oriented groove 21 on inner pipe 6 is coincided or staggered with inner layer oriented groove 20 on controlling rod 7. The other structure of the embodiment is the same as embodiment 1, no more to say here.

Embodiment 6

Figure 10:
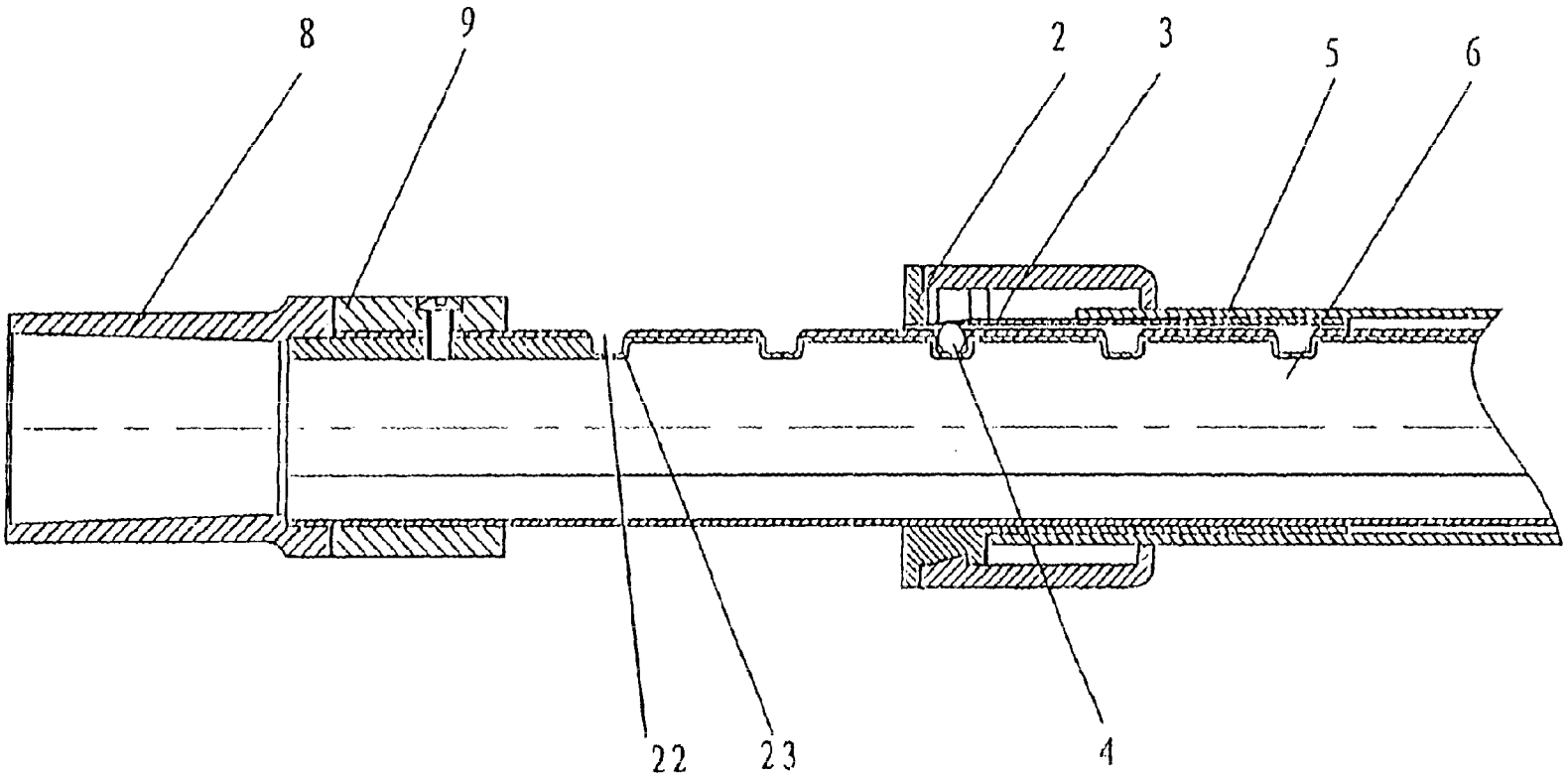
FIG. 10 is a structural sketch of the sixth embodiment of the invention.
Figure 11:
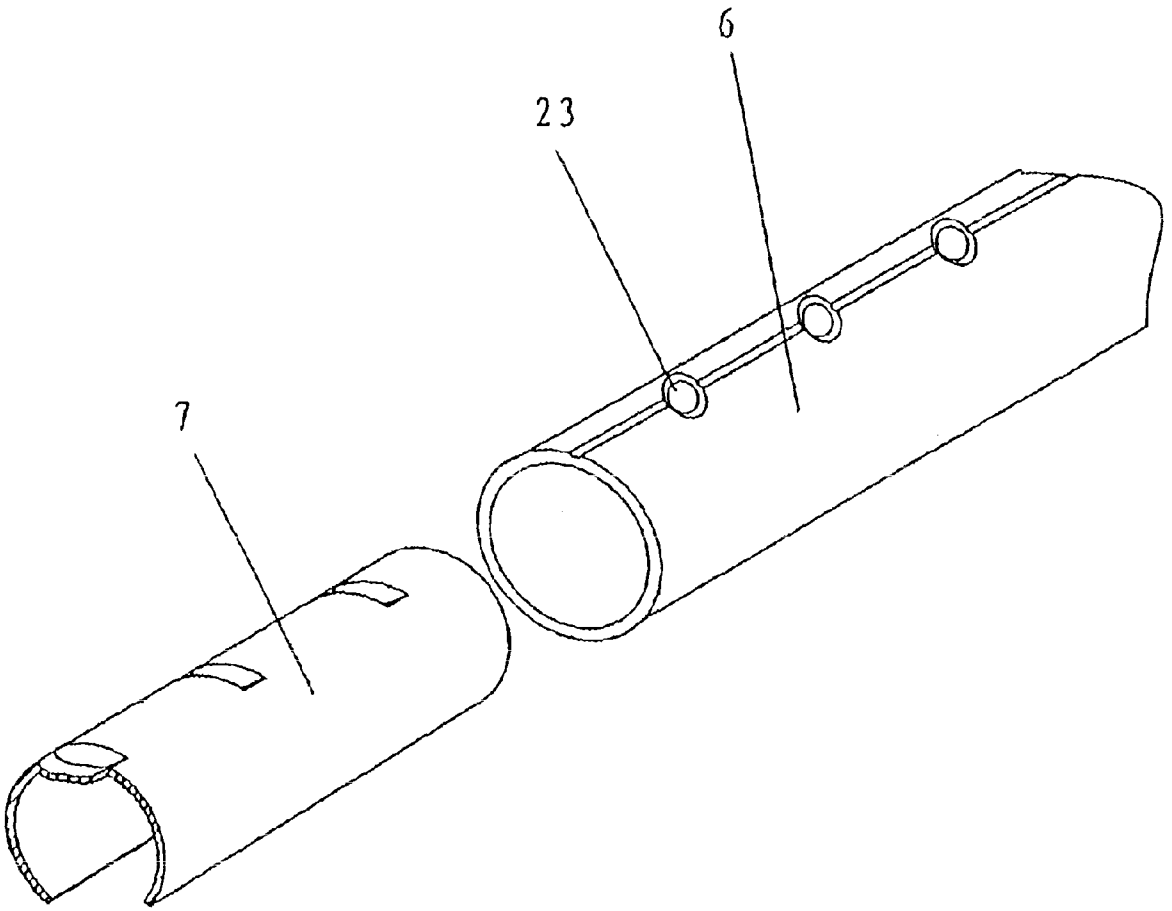
FIG. 11 is a structural sketch of inner pipe and controlling rod of the sixth embodiment of the invention.

The structure of the embodiment is referring as shown in FIG. 10 and 11, includes inner pipe 6 and outer pipe 5, wherein a controlling rod 7 is arranged slidingly on the wall of inner pipe 6. In the embodiment, outer layer oriented groove 23 is arranged axially on inner pipe 6. Inner layer oriented groove 22 is arranged axially on controlling rod 7. When controlling rod 7 and inner pipe 6 produces radial relative movement, that is revolving an angle relatively, outer layer oriented groove 23 on inner pipe 6 is coincided or staggered with inner layer oriented groove 22 on controlling rod 7. In the embodiment, an opening groove is arranged on inner pipe 6. One end of controlling rod 7 is extended out of the opening groove and connected with operating device 9 firmly. Revolving the operating device 9 an angle, it causes controlling rod 7 to produce radial movement relatively to inner pipe 6. Locking element 4 is pushed out by side wall of inner layer oriented groove 22 arranged on inner pipe 6 axially, locking state of inner pipe 6 and outer pipe 5 is released. Inner pipe 6 and outer pipe 5 could be axially extended or contracted relatively. Revolving the operating device 9 an angle back, can cause inner layer oriented groove 22 to coincide with outer oriented groove 23.

The operating method of the invention is in that, revolving operating device 9 an angle relatively to inner pipe 6, causes inner layer oriented groove 22 to stagger with outer layer oriented groove 23. At this time, extending or contracting of dust collecting pipe could be performed conveniently just by using one hand. When extending or contracting to a suitable length, revolving operating device 9 to the original position, it causes inner layer oriented groove 22 to coincide with outer layer oriented groove 23 again. Locking device 4 is pressed into oriented grooves coincided by elastic element 3. Outer pipe 5 and inner pipe 6 are locked.

What is claimed is:

1. A telescopic dust collecting pipe for a vacuum cleaner comprises an outer pipe, an inner pipe inserted in the outer pipe, and a locking mechanism for locking the relative position of the inner pipe and outer pipe, wherein an oriented groove is arranged on the outer surface of said inner pipe axially at intervals; a controlling rod is arranged in the inner pipe slidingly, an oriented groove corresponding to the oriented groove on the inner pipe at intervals is arranged on the controlling rod to form an outer layer oriented groove and an inner layer oriented groove; relative movement between the controlling rod and the inner pipe brings the outer layer oriented groove to coincide or stagger with the inner layer oriented groove; between the outer pipe and the inner pipe a locking element moved along radial direction is arranged; the locking element is pressed against one side of the inner pipe by an elastic element; when two layer oriented grooves are coincided, the locking element is pressed into the grooves coincided, and both the outer and inner pipes are locked relatively; when two layer oriented grooves are staggered, the locking element is pushed out of the oriented groove, and the locking state of the outer and inner pipes is released.

2. The apparatus of claim 1, wherein said controlling rod is arranged slidingly on an inner wall of the inner pipe, the oriented groove on the inner pipe forms the outer layer oriented groove, and the oriented groove on the controlling rod forms inner layer oriented groove.

3. The apparatus of claim 2, wherein an operating device is sheathed slidingly on the inner pipe, and the operating device is connected with one end of the controlling rod.

4. The apparatus of claim 3, wherein said operating device is arranged on an end of the inner pipe.

5. The apparatus of claim 1, wherein a hollow rack is fixed on said inner pipe axially, the outer layer oriented groove is arranged on the hollow rack, and said controlling rod is arranged slidingly along an inner wall of the hollow rack.

6. The apparatus of claim 1, wherein said inner pipe forms an axially hollow rack directly, the outer layer oriented groove is arranged on the hollow rack, and said controlling rod is arranged slidingly along an inner wall of the hollow rack.

7. The apparatus of claim 1, wherein a side wall of said inner layer oriented groove is sloped.

8. The apparatus of claim 7, wherein the intersection of sloped groove wall faces of two sides of said inner layer oriented groove is in a groove bottom of the inner layer oriented groove.

9. The apparatus of claim 1, wherein an end sleeve is fixed on said outer pipe, and said locking element pressed by the elastic element is arranged in the end sleeve.

10. The apparatus of claim 1, wherein an operating device which may control relative movement of the controlling rod and the inner pipe is arranged between said inner pipe and outer pipe.

11. The apparatus of claim 10, wherein said operating device is sheathed slidingly on inner pipe, and the operating device is connected with one end of the controlling rod.

12. The apparatus of claim 10, wherein said operating device is arranged on the inner pipe.

13. The apparatus of claim 10, wherein an axial elastic recovering device is arranged in said operating device.

14. The apparatus of claim 11, wherein said operating device is arranged on an end of the inner pipe.

15. The apparatus of claim 1, wherein said locking element is a roller.

16. The apparatus of claim 1, wherein said locking element is a locking block.

17. The apparatus of claim 1, wherein said locking element is a rolling ball.

18. The apparatus of claim 1, wherein relative movement of said controlling rod and inner pipe is along an axial direction.

19. The apparatus of claim 1, wherein relative movement of said controlling rod and inner pipe is along a rotational direction.

20. A telescopic dust collecting pipe for a vacuum cleaner comprises an outer pipe, an inner pipe inserted in the outer pipe, and a locking mechanism for locking the relative position of the inner pipe and outer pipe, wherein an oriented groove is arranged on the outer surface of said inner pipe axially at intervals; a controlling rod is arranged on the outer wall of the inner pipe slidingly and a part of the control rod is located between the outer and inner pipes, an oriented groove corresponding to the oriented groove on the inner pipe at intervals is arranged on the controlling rod to form an outer layer oriented groove and an inner layer oriented groove, wherein the oriented groove on inner pipe forms inner layer oriented groove, the oriented groove on controlling rod forms outer layer oriented groove; relative movement between the controlling rod and the inner pipe brings the outer layer oriented groove to coincide or stagger with the inner layer oriented groove; between the outer pipe and the inner pipe a locking element moved along radial direction is arranged; the locking element is pressed against one side of the inner pipe by an elastic element; when two layer oriented grooves are coincided, the locking element is pressed into the grooves coincided, and both the outer and inner pipes are locked relatively; when two layer oriented grooves are staggered, the locking element is pushed out of the oriented groove, and the locking state of the outer and inner pipes is released.

21. The apparatus of claim 20, wherein a hollow rack is fixed axially on said inner pipe, the inner layer oriented groove is arranged on the hollow rack, and said controlling rod is arranged slidingly along an outer wall of the hollow rack.

22. The apparatus of claim 20, wherein said inner pipe forms a hollow rack axially, the inner layer oriented groove is arranged on the hollow rack, and said controlling rod is arranged slidingly along an outer wall of the hollow rack.

23. A telescopic dust collecting pipe for a vacuum cleaner comprises an outer pipe, an inner pipe inserted in the outer pipe, and a locking mechanism for locking the relative position of the inner pipe and outer pipe, wherein an oriented groove is arranged on the outer surface of said inner pipe axially at intervals; a controlling rod is arranged in the inner pipe slidingly, an oriented groove corresponding to the oriented groove on the inner pipe at intervals is arranged on the controlling rod to form an outer layer oriented groove and an inner layer oriented groove; relative movement between the controlling rod and the inner pipe brings the outer layer oriented groove to coincide or stagger with the inner layer oriented groove; between the outer pipe and the inner pipe a locking element moved along radial direction is arranged, said locking element and said outer layer oriented groove being sized and shaped to be laterally moveable with respect to each other; the locking element is pressed against one side of the inner pipe by an elastic element; when two layer oriented grooves are coincided, the locking element is pressed into the grooves coincided, and both the outer and inner pipes are locked relatively; when two layer oriented grooves are staggered, the locking element is pushed out of the oriented groove, and the locking state of the outer and inner pipes is released.

* * * * *